United States Patent [19]

Allen

[11] 3,964,546

[45] June 22, 1976

[54] THERMAL RECOVERY OF VISCOUS OIL

[75] Inventor: Joseph C. Allen, Bellaire, Tex.

[73] Assignee: Texaco Inc., New York, N.Y.

[22] Filed: June 21, 1974

[21] Appl. No.: 481,580

[52] U.S. Cl. ..... 166/261; 166/259; 166/272

[51] Int. Cl.[2] ..... E21B 43/24

[58] Field of Search ..... 166/261, 260, 251, 256, 166/259, 272; 208/11

[56] References Cited

UNITED STATES PATENTS

| | | | |
|---|---|---|---|
| 2,695,163 | 11/1954 | Pearle et al. | 166/259 |
| 2,839,141 | 6/1958 | Walter | 166/261 |
| 3,036,632 | 5/1962 | Koch | 166/256 |
| 3,150,715 | 9/1964 | Dietz | 166/261 |
| 3,411,578 | 11/1968 | Holmes | 166/256 |
| 3,465,822 | 9/1969 | Klein | 166/256 |
| 3,563,312 | 2/1971 | Zwicky | 166/261 |

FOREIGN PATENTS OR APPLICATIONS

| | | | |
|---|---|---|---|
| 1,102,053 | 2/1968 | United Kingdom | 166/261 |

*Primary Examiner*—Stephen J. Novosad
*Assistant Examiner*—George A. Suckfield
*Attorney, Agent, or Firm*—Thomas H. Whaley; Carl G. Ries

[57] ABSTRACT

A method for recovering low gravity viscous oils and bitumens from a subterranean formation by the simultaneous injection of an oxygen-containing gas and steam so as to control the combustion, followed by a conventional in-situ combustion, after which the formation may be scavenged by water injection.

9 Claims, No Drawings

THERMAL RECOVERY OF VISCOUS OIL

BACKGROUND OF THE INVENTION

This invention relates to a method for recovering hydrocarbons from a subterranean hydrocarbon-bearing formation containing low gravity viscous oils or bitumens. More particularly, this invention relates to recovery of hydrocarbons from tar sands by thermal means.

The recovery of viscous oils from formations and bituments from tar sands by conventional methods has generally been unsuccessful because of the high viscosity and low mobility of the oil or bitumens. While some success has been realized in stimulating recovery of heavy oils by the use of thermal methods, essentially no success has been realized in recovering bitumens from tar sands. Bitumens can be regarded as highly viscous oils having a gravity in the range of about 5 to 10° API and contained in an essentially unconsolidated sand. These formations containing bitumens are referred to as tar sands. One such deposit is Athabasca tar sands located in Alberta, Canada, which deposit is estimated to contain several hundred billion barrels of oil.

Among the conventional thermal recovery methods applied to produce viscous hydrocarbons from formations and bitumens from the tar sands are steam injection, hot water injection and in-situ combustion. In employing steam and hot water injection the viscous hydrocarbons are heated to a temperature at which their viscosity is sufficiently reduced and their mobility is sufficiently improved so as to enhance their flow through the pores of the formation. In the use of in-situ combustion, much higher temperatures are realized whereby the in-place crude or bitumen also undergoes at least partial thermocracking or visbreaking to increase its mobility.

In operating the conventional in-situ combustion process an oxygen-containing gas such as air is introduced into the formation via a well and combustion of the in-place crude adjacent the wellbore is initiated by one of many accepted means, such as the use of a downhole gas-fired heater or downhole electric heater or chemical means. Thereafter, the injection of the oxygen-containing gas is continued so as to maintain the high temperature combustion front which is formed, and to drive the front through the formation toward the production well.

As the combustion front advances through the formation, a swept area consisting, ideally, of a clean sand matrix, is created behind the front. Ahead of the advancing front various contiguous zones are built up that also are displaced ahead of the combustion front. These zones may be envisioned as a distillation and cracking zone, a condensation and vaporization zone, an oil bank and a virgin, or unaltered zone.

The temperature of the combustion front is generally in the range of 750°–1200° F. The heat generated in this zone is transferred to the distillation and cracking zone ahead of the combustion front where the crude undergoes distillation and cracking. In this zone, a sharp thermal gradient exists wherein the temperature drops from the temperature of the combustion front to about 300°–450° F. As the front progresses and the temperature in the formation rises, the heavier molecular weight hydrocarbons of the oil become carbonized. These coke-like materials are deposited on the matrix and are the potential fuel to sustain the progressive in-situ combustion.

Ahead of the distillation and cracking zone is a condensation and vaporization zone. This zone is a thermal plateau and its temperature is in the range of from about 200° to about 450° F., depending upon the distillation characteristics of the fluids therein. These fluids consist of water and steam and hydrocarbon components of the crude.

Ahead of the condensation and vaporization zone is an oil bank which forms as the in-situ combustion progresses and the formation crude is displaced toward the production well. This zone is high oil saturation contains not only reservoir fluids but also condensate, cracked hydrocarbons and gaseous productions of combustion which eventually reach the production well from which they are produced.

Various improvements relating to in-situ combustion are described in the prior art that relate to the injection of water, either simultaneously or intermittently with the oxygen-containing gas to scavenge the residual heat in the formation behind the combustion front, thereby increasing recovery of oil. Prior art also discloses regulating the amount of water injected so as to improve conformance or sweep and to control the combustion.

Despite the use of these thermal recovery techniques none has been particularly successful since long periods of time and considerable amounts of thermal energy are required to heat up a formation sufficiently to obtain the desired reduction in viscosity and improved mobility.

There is the additional difficulty caused by the fact that heavy oils have a high percent of high molecular weight components. These high molecular weight components are carbonized ahead of the advancing combustion front and form the potential fuel for sustaining in-situ combustion. Because of the high percent of these high molecular weight components, there is an undesirable high fuel requirement and consequent low recovery. A further difficulty that occurs is that because of the low rate of propagation of in-situ combustion, the displaced hydrocarbons are cooled and hence become more immobile, thereby causing blockage of the formation, with the result that the progress of the front is impeded and the combustion cannot be sustained.

The difficulties recited above become compounded when these techniques are applied to the tar sands, because not only do the tar sands have a low gravity, i.e., 6°–8° API and a higher viscosity, i.e., in the millions of centipoises; but also the permeability is so low that difficulty has been experienced in establishing fluid communication within the formation.

The present invention seeks to overcome these difficulties by the application of a combination of thermal techniques that can best exploit the advantages of each technique.

SUMMARY OF THE INVENTION

This invention relates to an improved method for recovering low gravity viscous oil and more particularly, to the recovery of bitumen from tar sands by the simultaneous injection of an oxygen-containing gas and steam to control the combustion and improve the gas saturation, after which a conventional in-situ combustion is initiated, followed by water injection.

DESCRIPTION OF THE PREFERRED EMBODIMENT

The object of this invention is accomplished by a combination of controlled combustion and conventional in-situ combustion whereby a gas saturation is developed in the formation prior to the undertaking of a conventional in-situ combustion. By the method of the invention the benefits of improved transmissibility, improved mobility and reduced viscosity are realized.

The invention utilizes a sequence of steps involving first the simultaneous injection of an oxygen-containing gas and steam at a low temperature whereby a gas saturation is established in the formation. Thereafter, the injection of the steam is terminated and a conventional in-situ combustion is carried out to displace the hydrocarbons through the formation to a producing well from which they are produced. Optionally, the formation may thereafter be waterflooded, whereby the residual heat of the formation is scavenged.

In a broad aspect of the invention a hydrocarbon-bearing formation containing a heavy crude or bitumen is first traversed by at least an injection well and a production well, and fluid communication and injectivity are established therebetween by methods such as conventional hydraulic fracturing techniques.

Injection of an oxygen-containing gas and steam is then undertaken via the injection well at a temperature at which a controlled low temperature combustion of a portion of the bitumen adjacent the injection wellbore can be effected. The temperature of the injected mixture may be in the range of from about 400° F. to about 800° F. Alternately, a combustion adjacent the injection well may be initiated using known techniques such as the use of an electric downhole heater or a downhole gas burner, or chemical means such as thermite. Once combustion is established, then the said gas and steam mixture is injected so as to effect the low temperature combustion.

After the controlled low temperature combustion is established in the vicinity of the injection well, the simultaneous injection of the oxygen-containing gas and steam is continued for a period of time to establish a gas saturation in the formation between the injection well and the production well, and at a temperature in the range of 400° F. to 800° F.

During the period of the simultaneous injection of oxygen-containing gas and steam mixture, production will occur at the production well by the displacement of the hydrocarbons of the formation that have resulted from visbreaking and mobility improvement. In addition, because of the low temperature oxidation, excessive carbonization or coking in the formation is minimized and the advantages of prevention of blockage due to carbonization are realized. Together with these benefits is the development of improved transmissibility of the formation to the injected gases by the establishment of a gas saturation. Once the gas saturation has been established as evidenced, for example, by gas production at the production well, the injection of the mixture of the oxygen-containing gas and steam is terminated and a conventional in-situ combustion is undertaken.

The conventional in-situ combustion is caused to occur by the cessation of the steam injection since the formation is at a temperature whereby in-situ combustion can be effected without further use of additional ignition techniques. Injection of the oxygen-containing gas is continued so as to develop within the formation the various contiguous zones characteristic of a conventional in-situ combustion as hereinbefore described. The combustion front is thereby moved through the formation and effectively displaces ahead of it the original in-place fluids and also the fluids that have been formed because of the oxidative processes that have occurred within the formation during the injection of the gas and steam mixture. After the combustion front has progressed through the formation to the production well, it is envisioned that water injection may be undertaken to scavenge the residual heat in the formation and to produce the residual hydrocarbons present therein.

To illustrate the invention, a laboratory test was performed using a tar sand from the McMurray formation in Alberta, Canada. Approximately 170 lbs. of tar sands containing approximately 1900 bbl/A-ft. of bitumen was packed in a test cell approximately 15 inches long and 18 inches in diameter. The cell was equipped for operating at controlled temperatures up to 420° F. and pressures of 300 psi, and contained simulated injection and production wells. A communications path of clean 20–40 mesh sand was placed between the simulated wells and fluid communication was established prior to commencement of a test by the injection of nitrogen. In the test the pressure was maintained at 300 psi and simultaneous injection of air and steam was undertaken whereby low temperature combustion was established within the cell. During this run, total recovery was obtained of about 47% and at a high production rate almost double at a recovery of 14% as compared to low rates when steam alone was injected. Furthermore, the results showed that the extraneous energy added to the system was about 600,000 BTU/bbl of produced bitumen as compared with from 1.2 to 1.6 million BTU/bbl that is typical of steam injection projects.

Thereafter, the residue from the above test containing about 1040 bbl/a-ft., was used in a conventional in-situ combustion test employing a low-heat loss cell using a vertical in-situ combustion. An injection air flux 1000 SCFH/ft.$^2$ at a pressure of 300 psig was used. Oil production commenced about 2.5 hours after in-situ combustion had been initiated. Maximum temperature was 1200° F. and was experienced early in the run, which temperature thereafter dropped to 1000° F. The air requirement for the run was about 13.5 MCF/bbl of produced oil or equivalent to a fuel requirement of about 200 bbl/A-ft. The effluent gas, which showed that an in-situ combustion process had occurred, contained 13.5% $CO_2$, 3.9% CO and 0.53% $CH_4$. Production during the conventional in-situ combustion did not occur following initiation, but occurred after a well-defined oil-bank had formed which was displaced to the outlet of the cell. The results showed that substantially all fluids were removed from the sand.

It is believed that the effectiveness of the invention results not only from the visbreaking and thermal effects that are realized, but also from the establishment of the gas saturation. When steam alone is injected into a reservoir that does not contain a gas saturation it is difficult, and sometimes impossible, to obtain adequate transmissibility from the injection to the producing well. The steam has to displace the formation fluid in order to obtain a gas saturation and steam permeability. Unless the wells are very close together saturation cannot be obtained because of the condensation of the steam in the cooler formation. It is postulated that by injecting air with the steam one is able to establish a gas saturation and permeability with a non-condensible gas and gaseous combustion products formed by low temperature oxidation. Production of the upgraded and more mobile fluids of the formation is realized.

Furthermore it is postulated that improved recovery is also realized by the rapid rate of recovery during the first stage of the process. In the conventional in-situ combustion recovery the high temperature zone is narrow and the propagation rate is low. In contrast, by the method of invention up to 50% of the in-place hydrocarbon may be recovered at a high rate, and at the same time minimizing the difficulties recited above.

That improved transmissibility occurs is shown from the analysis of test results. Virgin tar sand is very sticky and tacky. Fracturing is generally employed to obtain adequate fluid injectivity. By the controlled oxidation of the invention the tar sand system is converted from one of a highly impermeable sticky mass to a friable unconsolidated sand-hydrocarbon system that has high permeability resembling conventional heavy oil-unconsolidated systems, and which is thereby amenable to a conventional in-situ combustion recovery method.

Once the transmissibility has been established, the formation may then be further produced by movement of a combustion front through the formation thereby displacing substantially all of the remaining in-place fluids to the production well from which they are produced.

During the low temperature phase of the invention the preferred gas may be air or oxygen-enriched gas or gas consisting substantially of pure oxygen. The steam may be either saturated or superheated dependent upon the desired conditions of operation as to pressure and temperature, and the characteristics of the formation necessary to attain the temperature range desired.

During the conventional in-situ combustion, again the preferred oxygen-containing gas is air, although an oxygen-enriched gas or substantially pure oxygen may be used.

In the preferred embodiment of the invention, the subterranean hydrocarbon-bearing formation is first subjected to controlled low temperature combustion process by injection of a mixture of an oxygen-containing gas and steam. Preferably, high injection rates are employed to obtain high production rates and to establish the desired gas saturation in the formation with attendant heat of the formation. During this phase of the process, the underground formation undergoes a change involving thermal cracking and visbreaking resulting in an improvement in the transmissibility of the formation. Thereafter, the formation is subjected to a conventional in-situ combustion by the injection of an oxygen-containing gas above.

In another embodiment the formation may thereafter be scavenged by the injection of water to effect a waterflood of the formation so as to recover additional hydrocarbons therein and to scavenge residual heat present in the formation.

It is within the scope of the invention to apply this process by exploiting patterns in a field such as an inverted 5-spot or an in-line injection. For example, if an in-situ combustion could be initiated at the center well of an inverted 5-spot, the production would be in the four corner wells. After production has been stimulated, as evidenced by increased recovery at the production wells, water could be injected in the injection well while at the same time a second in-situ combustion could be begun at an adjacent pattern.

I claim:

1. In the method of in-situ combustion for recovering heavy oils and bitumen from subterranean hydrocarbon-bearing formations traversed by at least one injection well and at least one production well and having a low permeability, the improvement comprising:

a. injecting into said formation via said injection well a mixture of an oxygen-containing gas and steam to effect a controlled low-temperature combustion in the range of temperature from about 400° to about 800°F thereby heating said formation and establishing a gas saturation therein, b. terminating injection of said steam and continuing injection of said oxygen-containing gas to initiate an in-situ combustion in the vicinity of said injection well, c. continuing injection of said oxygen-containing gas to propagate said in-situ combustion through said formation toward said production well, d. producing said hydrocarbons via said production well.

2. The method of claim 1 wherein said oxygen-containing gas is substantially air.

3. The method of claim 1 wherein said oxygen-containing gas is substantially pure oxygen.

4. The method of claim 1 wherein said oxygen-containing gas is an oxygen-enriched gas.

5. The method of claim 1 wherein step (d) is followed by injection of water in an amount sufficient to scavenge said residual heat in said reservoir, thereby recovering additional hydrocarbons from said formation.

6. The method of claim 1 wherein said steam is saturated steam.

7. The method of claim 1 wherein said steam is superheated steam.

8. The method of claim 1 wherein said hydrocarbons are produced during steps (a) through (d).

9. The method of claim 1 wherein water is injected simultaneously with step (c).

* * * * *